US011525560B2

(12) United States Patent
Chen et al.

(10) Patent No.: US 11,525,560 B2
(45) Date of Patent: Dec. 13, 2022

(54) LAMP CLAMP AND LAMP APPARATUS APPLYING THE SAME

(71) Applicant: Qisda Corporation, Taoyuan (TW)

(72) Inventors: Hsiang-Yu Chen, Taoyuan (TW); Chih-Lung Huang, Taoyuan (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 17/341,515

(22) Filed: Jun. 8, 2021

(65) Prior Publication Data

US 2022/0034492 A1 Feb. 3, 2022

(30) Foreign Application Priority Data

Aug. 3, 2020 (CN) ..... 202010766474.2

(51) Int. Cl.
*F21V 21/088* (2006.01)
*F21V 21/28* (2006.01)
*F21V 33/00* (2006.01)

(52) U.S. Cl.
CPC ..... *F21V 21/0885* (2013.01); *F21V 21/28* (2013.01); *F21V 33/0048* (2013.01)

(58) Field of Classification Search
CPC ..... F21V 21/0885; F21V 21/28; F21V 33/0048
See application file for complete search history.

(56) References Cited

U.S. PATENT DOCUMENTS 5,379,201 A * 1/1995 Friedman ..... F21V 33/0052 362/253
10,731,833 B2 * 8/2020 Tsai ..... F21V 23/0464
11,268,653 B2 * 3/2022 Pang ..... F16M 13/00
2007/0212057 A1 * 9/2007 Liang ..... G03B 17/00 396/428
2018/0363889 A1 * 12/2018 Yen ..... F21V 21/088
2021/0165304 A1 * 6/2021 Tseng ..... G03B 17/561

FOREIGN PATENT DOCUMENTS

TW 201905380 A 2/2019

OTHER PUBLICATIONS

Office action of counterpart application by Taiwan IP Office dated Nov. 27, 2020.

* cited by examiner

*Primary Examiner* — Leah Simone Macchiarolo

(57) ABSTRACT

A lamp clamp used to fix a light source on an object is disclosed. The lamp clamp includes a first clamping member and a second clamping member. The first clamping member includes a lamp fixing portion, a connecting portion and a stopping portion. The lamp fixing portion is used to fix the light source.
The connecting portion is connected to the lamp fixing portion. The stopping portion is movably connected to the connecting portion and has a stopping surface selectively disposed at one of plural positions on the connecting portion. The second clamping member is connected to the connecting portion to clamp the object between the stopping surface and the second clamping member.

20 Claims, 5 Drawing Sheets

LAMP CLAMP AND LAMP APPARATUS APPLYING THE SAME

This application claims the benefit of People's Republic of China application Serial No. 202010766474.2, filed on Aug. 3, 2020, the subject matter of which is incorporated herein by reference.

BACKGROUND OF THE INVENTION

Field of the Invention

The invention relates in general to a lamp clamp and applications thereof and more particularly to a lamp clamp with a movable clamping member and a lamp apparatus applying the same.

Description of the Related Art

Most of conventional lighting apparatuses, such as chandeliers, downlights and table lamps, are fixed type and have a large volume. When the user only needs a local illumination or needs to increase the illumination at a local area, such as the screen of a display (such as the screen of a desktop or a laptop), a lamp apparatus that can be fixed on the display is used to make the light source of the lamp apparatus more adjacent to its screen.

A lamp apparatus which can be fixed on the monitor is already available in the market. For example, the lamp apparatus can be fixed on the display by a clamping member, and the weight of the lamp apparatus is supported by the clamping member. One end of the clamping member is clamped on an edge of the display and the other end of the clamping member holds the lamp. The clamping member is fixed on the display by clamping two opposite sides respectively located on the frame and the backboard of the display. As the frame of the display is designed to be narrower and narrower, the area for clamping the clamping member is reduced, and this makes the conventional clamping member unable to provide a sufficient clamping force to stably fix the lamp. This problem may get worse as the emergence of the displays with curved and ultra-thin screens. It has become an important task in the technology filed to stably clamp the lamp and at the same time preserve the overall aesthetics and completeness of the lamp apparatus.

Therefore, there is a need to provide an advanced lamp clamp and applications thereof to resolve the problems encountered in the prior art.

SUMMARY OF THE INVENTION

In one embodiment of the present disclosure, a lamp clamp used to fix a lamp apparatus on an object is disclosed, wherein the lamp clamp includes a first clamping member and a second clamping member. The first clamping member includes a lamp fixing portion, a connecting portion and a stopping portion. The lamp fixing portion is used to fix the lamp. The connecting portion is connected to the lamp fixing portion. The stopping portion is movably connected to the connecting portion and has a stopping surface selectively disposed at one of plural positions on the connecting portion. The second clamping member is connected to the connecting portion to clamp the object between the stopping surface and the second clamping member.

In another embodiment of the present disclosure, a lamp apparatus selectively clamped at an upper edge of a display is disclosed, wherein the display has a displaying surface and a back surface. The lamp apparatus includes a light source, a first clamping member and a second clamping member. The first clamping member includes a connecting portion and a stopping portion. The connecting portion is connected to the light source. The stopping portion is movably connected to the connecting portion and has a stopping surface selectively disposed at a first position or a second position of the connecting portion. The second clamping member is connected to the connecting portion. When the lamp apparatus is clamped at the upper edge of the display, the stopping surface contacts to a third position of the displaying surface, and the second clamping member contacts to the back surface. When the stopping surface is disposed at the first position, the light source is separated from the displaying surface at the third position by a first distance. When the stopping surface is disposed at the second position, the light source is separated from the displaying surface at the third position by a second distance. The second distance is greater than the first distance.

According to the above embodiments of the present disclosure, a lamp clamp and a lamp apparatus applying the same are disclosed. The lamp clamp includes two clamping members s used to fix a light source of the lamp apparatus on an object. At least one of the two clamping members has a movable stopping portion movably connected to the corresponding clamping member in a non-elastic reciprocating manner to provide a steady clamping force to fix the light source on the object.

Additionally, by adjusting the position of the stopping portion, the clamping distance between two clamping members can be flexibly adjusted to fit different shapes and thicknesses of various objects. Alternatively, suppose the shape and thickness of the clamped object remain unchanged, the distance between the clamped object and the light source can be adjusted by adjusting the position of the stopping portion. Thus, without jeopardizing the completeness of the original structure as well as the external aesthetics of the lamp clamp, the clamping distance or the distance between the light source and the object can be adjusted to meet the user's operation requirement to increase the convenience and reliability of use.

The above and other aspects of the invention will become better understood with regard to the following detailed description of the preferred but non-limiting embodiment (s). The following description is made with reference to the accompanying drawings.

DETAILED DESCRIPTION OF THE INVENTION

The present disclosure provides a lamp clamp and a lamp apparatus applying the same capable of changing the clamping distance or the distance between the light source of the lamp apparatus and the object according to the user's operation requirement to increase the convenience and reliability of use. For the object, technical features and advantages of the present disclosure to be more easily understood by anyone ordinary skilled in the technology field, a number of exemplary embodiments are disclosed below with detailed descriptions and accompanying drawings.

It should be noted that these embodiments are for exemplary and explanatory purposes only, not for limiting the scope of protection of the invention. The invention can be implemented by using other features, elements, methods and parameters. The preferred embodiments are merely for illustrating the technical features of the invention, not for limiting the scope of protection. Anyone skilled in the technology field of the invention will be able to make suitable modifications or changes based on the specification disclosed below without breaching the spirit of the invention. Designations common to the accompanying drawings are used to indicate identical or similar elements.

Figure 1A:
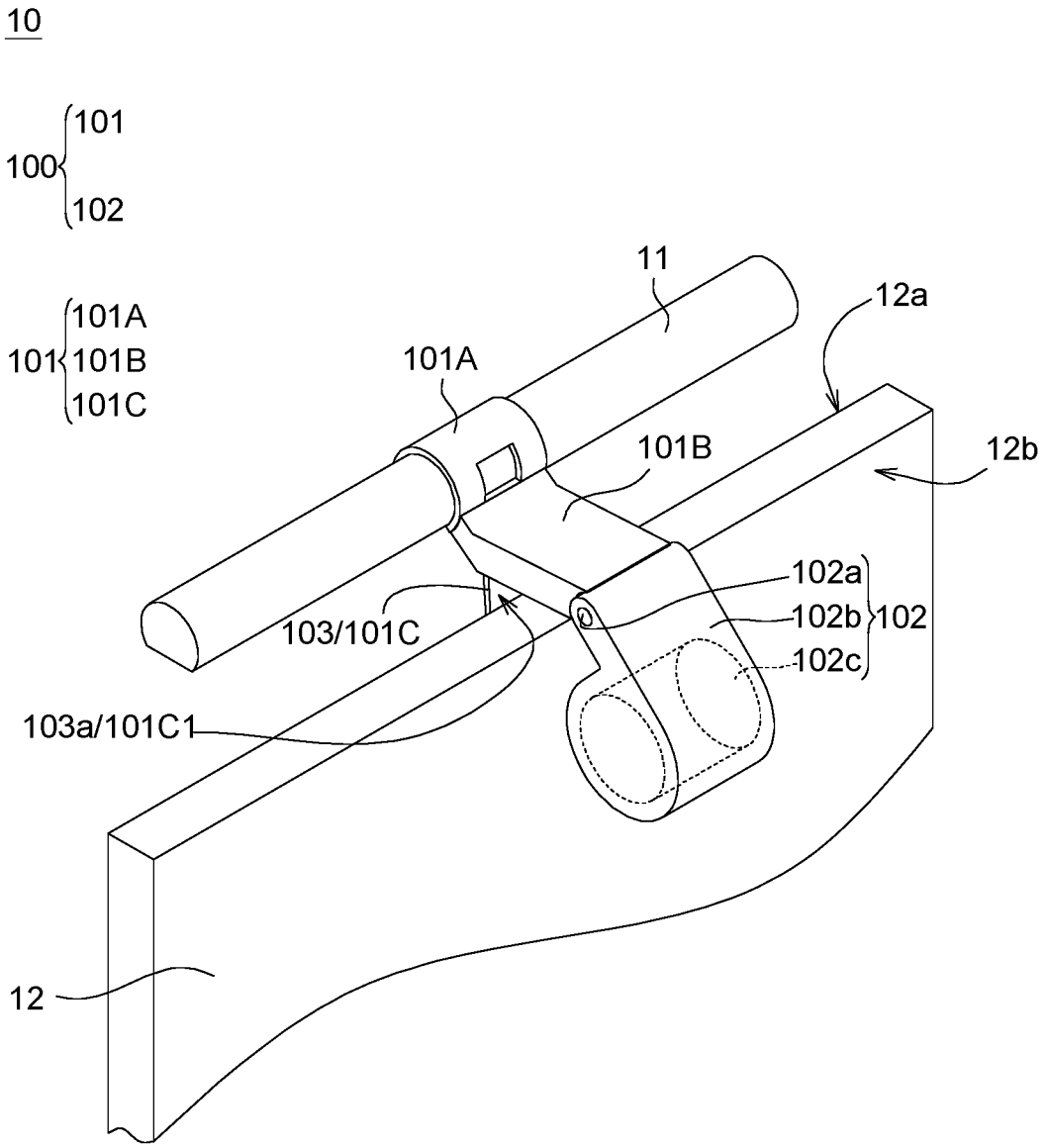
FIG. 1A is a perspective view of a lamp apparatus according to an embodiment of the present disclosure.
Figure 1B:
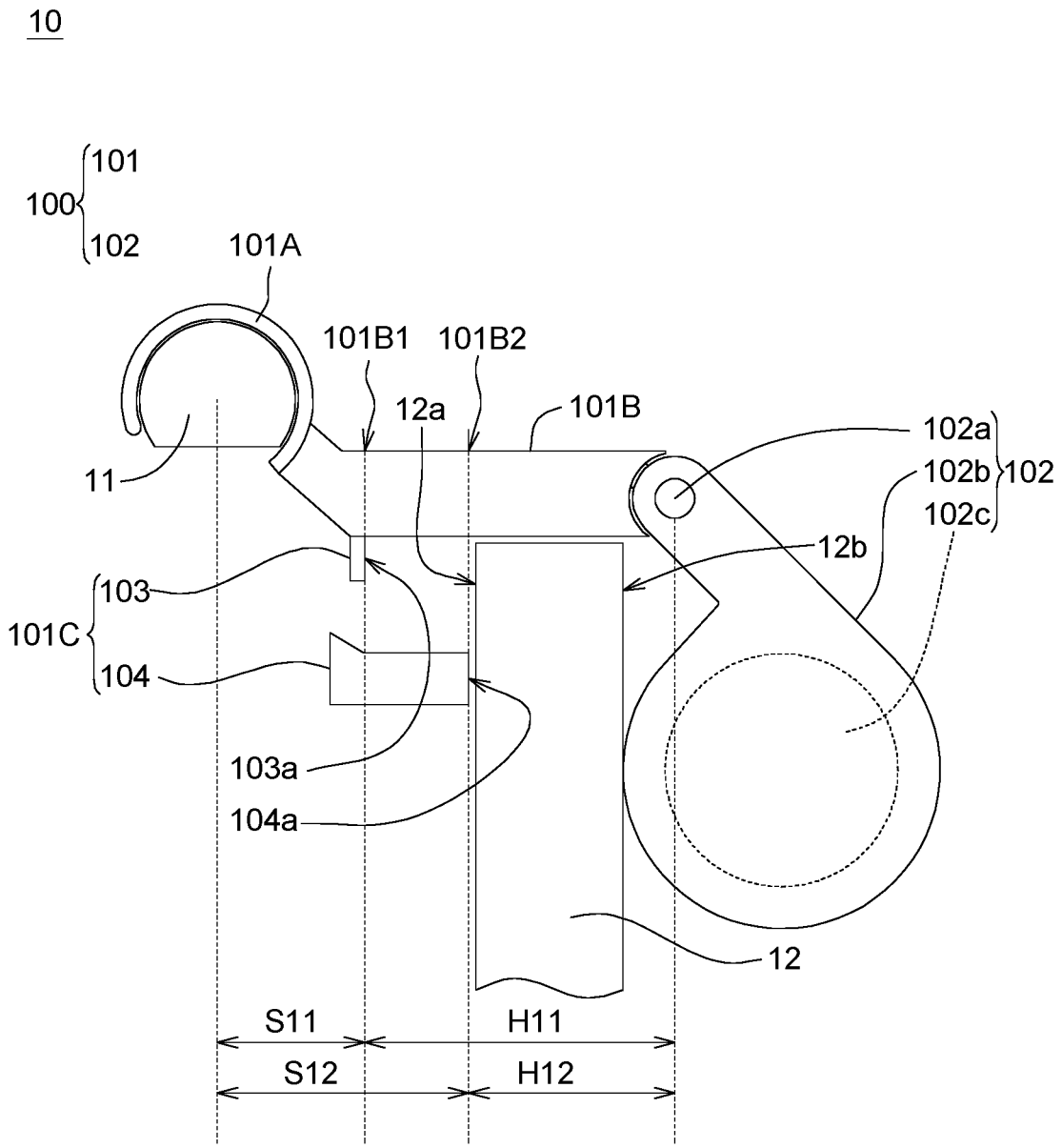
FIG. 1B is a cross-sectional view of a lamp clamp applied by the lamp apparatus as depicted in FIG. 1A.

Refer to FIGS. 1A and 1B. FIG. 1A is a perspective view of a lamp apparatus10 according to an embodiment of the present disclosure. FIG. 1B is a cross-sectional view of a lamp clamp 100 applied by the lamp apparatus 10 as depicted in FIG. 1A. According to the design of the lamp apparatus 10 as shown in FIG. 1A, the lamp apparatus 10 is a lighting apparatus having at least one light source 11 used to be fixed on an object 12 by the lamp clamp 100 to provide a local illumination to the object 12.

In some embodiments of the present disclosure, the object 12 can be a display monitor, a bookcase, a desk, a bedside table, a work table or other device or hardware equipment that requires local illumination. In the present embodiment, the object 12 can be a display monitor. The light source 11 can be realized by a tube fixed on the lamp clamp 100. The lamp clamp 100 and the light source 11 can be combined to form a lamp apparatus 10 which can be selectively clamped at the upper edge of the display 12.

The lamp clamp 100 includes a first clamping member 101 and a second clamping member 102. The first clamping member 101 includes a lamp fixing portion 101A, a connecting portion 101B and a stopping portion 101C. The lamp fixing portion 101A is used to fix the light source 11. The connecting portion 101B is connected to the lamp fixing portion 101A. The stopping portion 101C is movably connected to the connecting portion 101B and has a stopping surface 101C1 selectively fixed at one of plural positions on the connecting portion 101B. The second clamping member 102 is connected to the connecting portion 101B to clamp the object 12 between the stopping surface 101C1 of the stopping portion 101C of the first clamping member 101 and the second clamping member 102.

In some embodiments of the present disclosure, the lamp fixing portion 101A includes a C-shaped elastic clip, in which the light source 11 is clamped. In the present embodiment, one end of the C-shaped elastic clip of the lamp fixing portion 101A is interconnected and integrally formed in one piece with the connecting portion 101B. However, the connection between the lamp fixing portion 101A and the connecting portion 101B is not limited to this regard. In some other embodiments the present disclosure, the C-shaped elastic clip of the lamp fixing portion 101A can be movably connected to the connecting portion 101B via a slot, a sliding rail or other movable connector (not shown).

In some embodiments of the present disclosure, the second clamping member 102 includes a pivot shaft 102*a*, a clamping portion 102*b* and a counterweight block 102*c*. The pivot shaft 102*a* passes through the connection point between the second clamping member 102 and the connecting portion 101B and pivotally connects the clamping portion 102*b* to the connecting portion 101B, such that the clamping portion 102*b* can movably rotate around the pivot shaft 102*a*. Besides, the counterweight block 102*c* is disposed in the clamping portion 102*b*. Under the influence of gravity, the counterweight block 102*c* can generate a clockwise torque relative to the pivot shaft 102*a*, and the light source 11 alongside the first clamping member 101 can generate an anticlockwise torque relative to the pivot shaft 102*a*. The stopping portion 101C of the first clamping member 101 and the second clamping member 102 are respectively driven by the two torque to move towards to each other, and both lean on the object 12 to form a clamping force to clamp the object 12. In the present embodiment, the stopping portion 101C of the first clamping member 101 can lean on of the upper edge 12*a* of the displaying surface of the display (the object 12); and the second clamping member 102 can lean on the back surface 12*b* of the display.

The stopping portion 101C of the first clamping member 101 includes a first stopping wall 103 and a second stopping wall 104. The first stopping wall 103 is protruded from the first position 101B1 of the connecting portion 101B and has a first surface 103*a* facing the second clamping member 102. The second stopping wall 104 is detachably connected to the connecting portion 101B and extended to the second position 101B2 of the connecting portion 101B, and has a second surface 104*a* facing the second clamping member 102. The second surface 104*a* of the second stopping wall 104 is closer to the pivot shaft 102*a* of the second clamping member 102 than the first surface 103*a* of the first stopping wall 103.

In detail, the second stopping wall 104 can be a casing, and when the casing of the second stopping wall 104 is detachably mounted on the first stopping wall 103, the second surface 104*a* is located at the second position 101B2 of the connecting portion 101B and used as the stopping surface 101C1 of the stopping portion 101C. The second surface 104*a* and the second clamping member 102 can work together to clamp the display (the object 12). When the casing of the second stopping wall 104 is dismounted from the first stopping wall 103, the first surface 103*a* of the first stopping wall 103 is located at (corresponds to) the first position 101B1 of the connecting portion 101B and used as the stopping surface 101C1 of the stopping portion 101C. The first surface 103*a* and the second clamping member 102 can work together to clamp the display (the object 12).

When the stopping surface 101C1 is located at the first position 101E31 of the connecting portion 101B, the stopping surface 101C1 (the first surface 103*a* of the first stopping wall 103) is separated from the pivot shaft 102*a* of the second clamping member 102 by a distance H11. When the stopping surface 101C1 is located at the second position 101B2, the stopping surface 101C1 (the second surface 104*a* of the second stopping wall 104) is separated from the pivot shaft 102*a* of the second clamping member 102 by a distance H12. The distance H11 is greater than the distance H12. By selecting the first surface 103*a* of the first stopping wall 103 and the second surface 104*a* of the second stopping wall 104 to serve as the stopping surface 101C1 of the stopping portion 101C, the lamp clamp 100 can be adapted to different thicknesses of various displays (the object 12).

Furthermore, suppose the thickness of the display (the object 12) remains unchanged and the second clamping member 102 can be pivotally rotated. When the stopping surface 101C1 is located at the first position 101B1, the position by which the stopping surface 101C1 (the first surface 103*a* of the first stopping wall 103) touches the displaying surface (the upper edge 12*a* of the displaying surface) is separated from the light source 11 by a distance S11. When the stopping surface 101C1 is located at the second position 101B2, the position by which the stopping surface 101C1 (the second surface 104*a* of the second stopping wall 104) touches the displaying surface (the upper edge 12*a* of the displaying surface) is separated from the light source 11 by a distance S12. The distance S12 is greater than the distance S11. By selecting the first surface 103*a* of the first stopping wall 103 and the second surface 104*a* of the second stopping wall 104 to serve as the stopping surface 101C1 of the stopping portion 101C of the first clamping member 101, the distance between the displaying surface and the light source 11 can be adjusted.

Figure 2A:
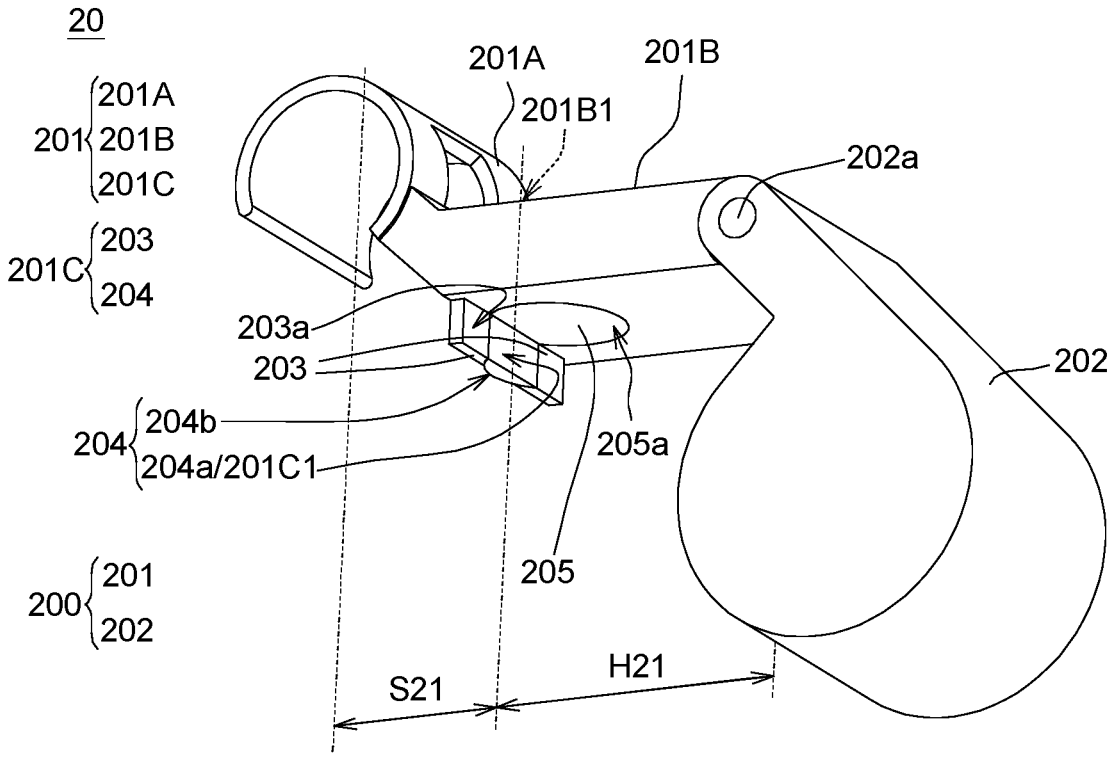
FIG. 2A and FIG. 2B are perspective views respectively illustrating the partial structure of the lamp apparatus in different operating states according to another embodiment of the present disclosure.
Figure 2B:
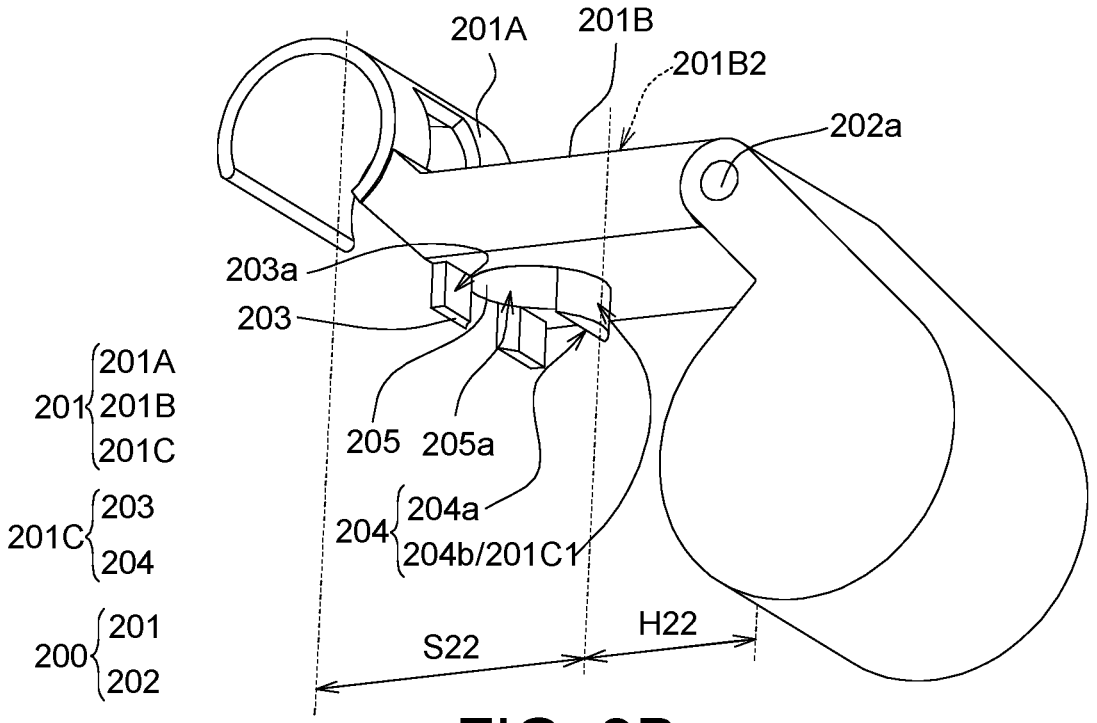

Referring to FIG. 2A and FIG. 2B, FIG. 2A and FIG. 2B are perspective views respectively illustrating the partial structure of the lamp apparatus 20 in different operating states according to another embodiment of the present disclosure. The structure of the lamp apparatus 20 is basically similar to that of the lamp apparatus 10 except for the structure of the first clamping member 201 of the lamp apparatus 20.

In the present embodiment, the light source (not illustrated) of the lamp apparatus 20 is fixed on the display (not illustrated) by a lamp clamp 200. The lamp clamp 200 includes a first clamping member 201 and a second clamping member 202. The first clamping member 201 includes a lamp fixing portion 201A, a connecting portion 201B and a stopping portion 201C. The stopping portion 201C of the first clamping member 201 includes a first stopping wall 203 and a second stopping wall 204. The first stopping wall 203 is protruded from a first position 201B1 of the connecting portion 201B and has a fixing surface 203*a* facing the second clamping member 202. The second stopping wall 204 is rotatably connected to the connecting portion 201B and has a first surface 204*a* and a second surface 204*b* respectively disposed on the opposite sides of the first surface 204*a*. When the second stopping wall 204 is disposed at the first rotation position, the first surface 204*a* and the fixing surface 203*a* are co-planar to face the second clamping member 202 (as shown in FIG. 2A). When the second stopping wall 204 is disposed at the second rotation position, the second surface 204*b* faces the second clamping member 202 and is closer to the pivot shaft 202*a* of the second clamping member 202 than the first surface 204*a* (as shown in FIG. 2B).

In detail, the stopping portion 201C of the first clamping member 201 includes a turntable 205 rotatably and pivotally connected to the connecting portion 201B. The turntable 205 has a rotation surface 205*a* perpendicular to the extending direction Z of the first stopping wall 203. The second stopping wall 204 is parallel to the extending direction Z of the first stopping wall 203 and is protruded from an edge of the rotation surface 205*a*. The first surface 204*a* of the second stopping wall 204 is a plane surface parallel to the fixing surface 203*a* of the first stopping wall 203. The second surface 204*b* of the second stopping wall 204 is an arced surface.

When the turntable 205 is rotated and makes the second stopping wall 204 disposed at the first rotation position (as shown in FIG. 2A), the second stopping wall 204 can be engaged with the first stopping wall 203. Meanwhile, the first surface 204*a* of the second stopping wall 204 is co-planar with the fixing surface 203*a* of the first stopping wall 203 and is disposed at (corresponds to) the first position 201B1 of the connecting portion 201B and faces the second clamping member 202. The fixing surface 203*a* of the first stopping wall 203 and the first surface 204*a* of the second stopping wall 204 can be combined to serve as the stopping surface 201C1 of the stopping portion 201C and work together with the second clamping member 202 to clamp the display (not shown).

When the turntable 205 is rotated and makes the second stopping wall 204 disposed at the second rotation position (as shown in FIG. 2B), the second stopping wall 204 moves away from the first stopping wall 203. Meanwhile, the second surface 204*b* of the second stopping wall 204 is disposed at (corresponds to) the second position 201B of the connecting portion 201B and faces the second clamping member 202. The second surface 204*b* of the second stopping wall 204 can serve as the stopping surface 201C1 of the stopping portion 201C and work together with the second clamping member 202 to clamp the display (not shown).

When the stopping surface 201C1 is disposed at the first position 201B1 of the connecting portion 201B, the stopping surface 201C1 (the combination of the first surface 204*a* and the fixing surface 203*a* of the first stopping wall 203) is separated from the pivot shaft 202*a* of the second clamping member 202 by a distance H21. When the stopping surface 201C1 is disposed at the second position 201B2, the stopping surface 201C1 (the second surface 204*b* of the second stopping wall 204) is separated from the pivot shaft 202*a* of the second clamping member 202 by a distance H22. The distance H21 is greater than the distance H22. By rotating the turntable 205 to selecting the first surface 204*a* of the first stopping wall 204 and the second surface 204*b* of the second stopping wall 204 as the stopping surface 201C1 of the stopping portion 201C, the lamp clamp 200 can be adapted to different thicknesses of various displays (the object 12).

Furthermore, suppose the thickness of the display remains unchanged and the second clamping member 202 can be pivotally rotated. When the stopping surface 201C1 is disposed at the first position 201B1, the position by which the stopping surface 201C1 (the first surface 204*a* of the second stopping wall 204) touches the displaying surface (not shown) of the display is separated from the light source (represented by the center point of the lamp fixing portion 201A) by a distance S21. When the stopping surface 201C1 is disposed at the second position 201B2, the position by which the stopping surface 201C1 (the second surface 204*a* of the second stopping wall 204) touches the displaying surface (not shown) of the display is separated from the light source by a distance S22. The distance S22 is greater than the distance S21. By rotating the turntable 205 to selecting the first surface 204*a* of the first stopping wall 204 and the second surface 204*b* of the second stopping wall 204 as the stopping surface 201C of the stopping portion 201, the distance between the displaying surface (not shown) of the display and the light source can be adjusted.

Figure 3A:
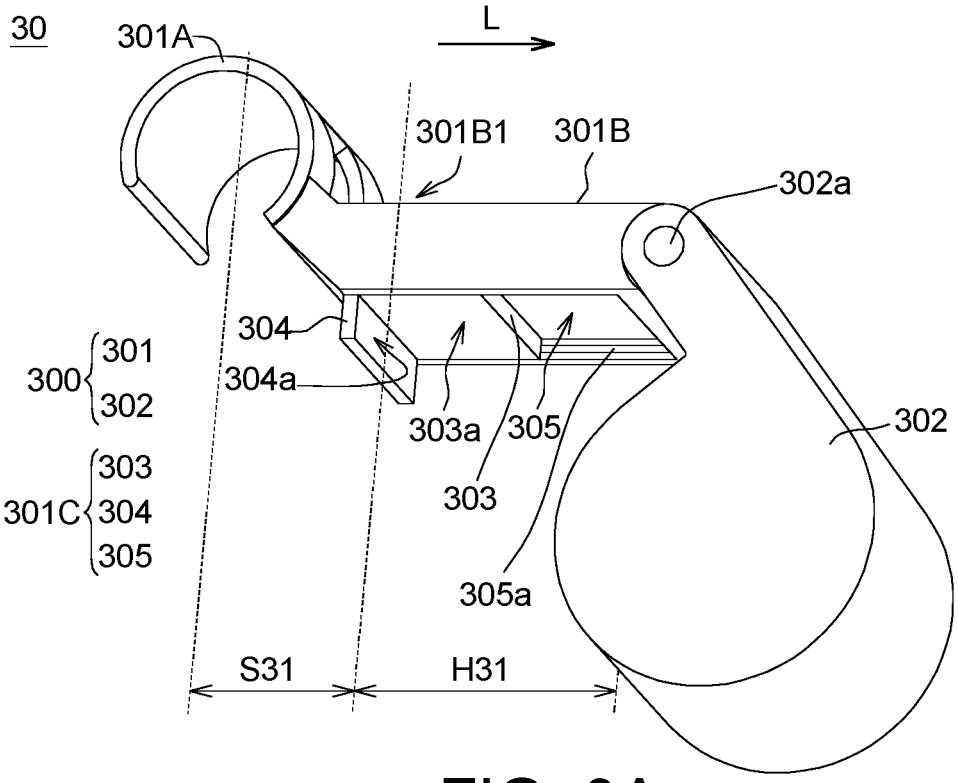
FIG. 3A and FIG. 3B are perspective views respectively illustrating the partial structure of the lamp apparatus in different operating states according to yet another embodiment of the present disclosure.
Figure 3B:
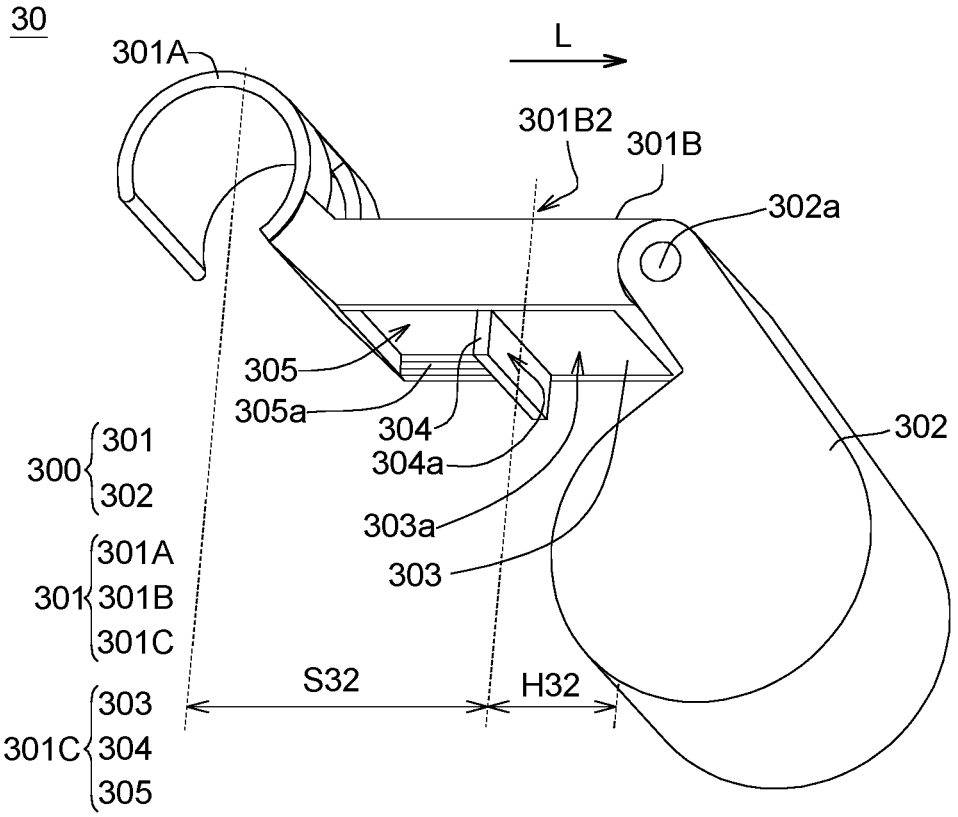
Figure 3C:
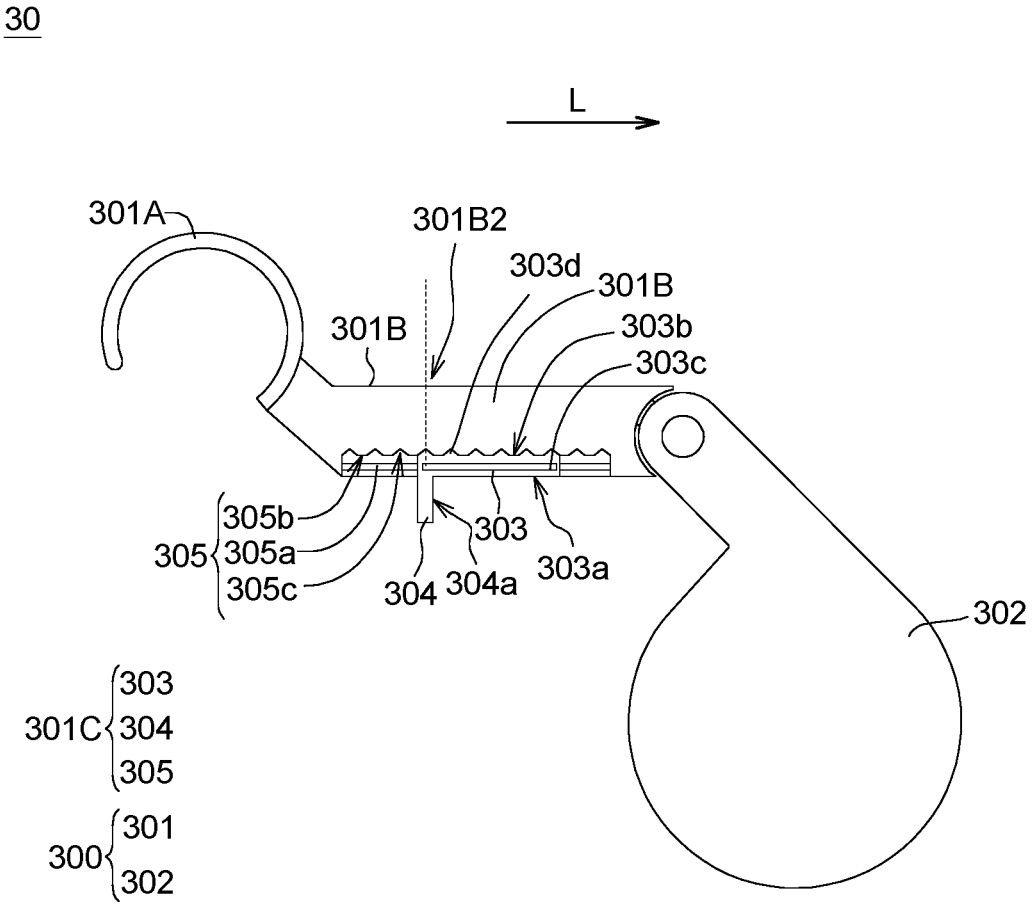
FIG. 3C is a side view illustrating the partial structure of the lamp apparatus as depicted in FIG. 3B.

Refer to FIG. 3A to FIG. 3C, FIG. 3A and FIG. 3B are perspective views respectively illustrating the partial structure of the lamp apparatus 30 in different operating states according to yet another embodiment of the present disclosure. FIG. 3C is a side view illustrating the partial structure of the lamp apparatus 30 as depicted in FIG. 3B. The structure of the lamp apparatus 30 is basically similar to that of the lamp apparatus 10 except the structure of the first clamping member 301 of the lamp apparatus 30.

In the present embodiment, the light source (not illustrated) of the lamp apparatus 30 is fixed on the display (not shown) by the lamp clamp 300. The lamp clamp 300 includes a first clamping member 301 and a second clamping member 302. The first clamping member 301 includes a lamp fixing portion 301A, a connecting portion 301B and a stopping portion 301C. The stopping portion 301C of the first clamping member 301 includes a sliding block 303 and a stopping wall 304. The sliding block 303 is slidably connected to the connecting portion 301B. The stopping wall 304 is protruded from a surface 303*a* of the sliding block 303 and has a stopping surface 304*a* perpendicular to the surface 303*a* of the sliding block 303 and facing the second clamping member 302. In the present disclosure, the parts on which the stopping surface 304*a* (or the first surface 103*a*, the second surface 104*a*, the first surface 203*a*, the first stopping wall 204*a* or the second stopping wall 204*b*) contacting to the upper edge of the displaying surface are normally covered with foam (not shown), such that the coefficient of friction of the touching surface is about 0.8. When the lamp apparatus 30 (10 or 20) clamped on the upper edge of the display 12, even when the contacting surface is not smooth, the foam still can be deformed to maintain a suitable touching area with the object and make the lamp apparatus 30 (10 or 20) stably fixed on the display 12.

In detail, the connecting portion 301B is has a sliding groove 305 parallel to the long axis L of the connecting portion 301B to receive the sliding block 303. In the present embodiment, the sliding block 303 has a bottom surface 303*b* located on the opposite side of the surface 303*a*. The bottom surface 303*b* faces the bottom 305*b* of the sliding groove 305. The sliding groove 305 has a guide groove 305*a* parallel to the long axis L of the connecting portion 301B (referring to FIG. 3A and FIG. 3B). The guide groove 305*a* is engaged with a guide rail 303*c* which protrudes from a side edge of the sliding block 303 and parallel to the guide groove 305*a* (referring to FIG. 3C), such that the sliding block 303 can be slidably disposed in the sliding groove 305 and drive stopping wall 304 to move on one of the plural positions (such as the first position 301B1 and the second position 301B2) along a direction parallel to the long axis L of the connecting portion 301B.

When stopping wall 304 is moved to the first position 301B1 of the connecting portion 301B (as shown in FIG. 3A), the stopping surface 304*a* of the stopping wall 304 faces the second clamping member 302 and works with the second clamping member 302 to clamp the display (not shown). Meanwhile, the stopping surface 304*a* is separated from the pivot shaft 302*a* of the second clamping member 302 by a distance H31. When stopping wall 304 is moved to the second position 301B2 of the connecting portion 301B (as shown in FIG. 3B), the stopping surface 304*a* of the stopping wall 304 faces the second clamping member 302 and works with the second clamping member 302 to clamp the display (not illustrated). Meanwhile, the stopping surface 304*a* is separated from the pivot shaft 302*a* of the second clamping member 302 by a distance H32. The distance H31 is greater than the distance H32. By sliding the sliding block 303 to select the position of the stopping surface 304*a*, the lamp clamp 300 can be adapted to different thicknesses of various displays (the object 12).

Furthermore, suppose the thickness of the display remains unchanged and the second clamping member 302 can freely slide. When the stopping surface 301C1 is disposed at the first position 301B1 of the connecting portion 301B, the position by which the stopping surface 301C1 (304*a*) touches the displaying surface (not shown) of the display is separated from the light source (represented by the center point of the lamp fixing portion 201A) of the lamp apparatus 30 by a distance S31. When the stopping surface 301C1 is disposed at the second position 301B2 of the connecting portion 301B, the position by which the stopping surface 301C1 (304*a*) touches the upper edge of the displaying surface (not shown) of the display is separated from the light source by a distance S32. The distance S32 is greater than the distance S31. By sliding the sliding block 303 to select the position of the stopping surface 304*a*, the distance between the displaying surface of the display and the light source can be adjusted.

In some embodiments, the sliding groove 305 further includes plural cavities 305*c* recessed to the bottom 305*b* of the sliding groove 305. Meanwhile, the sliding block 303 has at least one (preferably plural) protruding portion 303*d* protruding from the bottom 303*b* of the sliding block 303 and working with at least one of plural cavities 305*c* to fix the stopping surface 304*a* at the first position 301B1 or the second position 301B2 of the connecting portion 301B.

According to the above embodiments of the present disclosure, a lamp clamp and a lamp apparatus applying the same are disclosed. The lamp clamp includes two clamping members used to fix the light source of the lamp apparatus on an object. At least one of the two clamping members has a movable stopping portion movably connected to the corresponding clamping member in a non-elastic reciprocating manner to provide a steady clamping force to fix the light source on the object.

Additionally, by adjusting the position of the stopping portion, the clamping distance between two clamping members can be flexibly adjusted to fit different shapes and thicknesses of various objects. Alternatively, suppose the shape and thickness size of the clamped object remain unchanged. The distance between the clamped object and the light source can be adjusted by adjusting the position of the stopping portion. Thus, without jeopardizing the completeness of the original structure as well as the external aesthetics of the lamp clamp, the clamping distance or the distance between the light source and the object can be adjusted to meet the user's operation requirement to increase the convenience and reliability of use.

While the invention has been described by way of example and in terms of the preferred embodiment(s), it is to be understood that the invention is not limited thereto. On the contrary, it is intended to cover various modifications and similar arrangements and procedures and the scope of the appended claims therefore should be accorded the broadest interpretation so as to encompass all such modifications and similar arrangements and procedures.

What is claimed is:

1. A lamp clamp used to fix a light source on an object, wherein the lamp clamp comprises:

a first clamping member, comprising:

a lamp fixing portion, used to fix the light source;

a connecting portion, connected to the lamp fixing portion; and a stopping portion, movably connected to the connecting portion and having a stopping surface selectively disposed at one of a plurality of positions on the connecting portion for adjusting a distance between the lamp fixing portion and the stopping surface; and a second clamping member connected to the connecting portion to clamp the object between the stopping surface and the second clamping member.

2. The lamp clamp according to claim 1, wherein the second clamping member is connected to the connecting portion via a connection point; when the stopping surface is disposed at each of the plural positions, distances between the stopping surface and the lamp fixing portion are different.

3. The lamp clamp according to claim 1, wherein the stopping portion comprises:

a first stopping wall, protruded from a first position on the connecting portion and having a first surface facing the second clamping member; and a second stopping wall, detachably connected to the connecting portion, extending to a second position on the connecting portion and having a second surface facing the second clamping member; wherein the second surface is closer to the second clamping member than the first surface.

4. The lamp clamp according to claim 3, wherein the second stopping wall is a casing; when the casing is detachably mounted on the first stopping wall, the second surface serves as the stopping surface; when the casing is dismounted from the first stopping wall, the first surface serves as the stopping surface.

5. The lamp clamp according to claim 1, wherein the stopping portion comprises:

a first stopping wall, protruded from a first position on the connecting portion and having a fixing surface facing the second clamping member; and a second stopping wall, rotatably connected to the connecting portion and having a first surface and a second surface located on an opposite side of the first surface;

when the second stopping wall is disposed at a first rotation position, the first surface and the fixing surface are co-planar; when the second stopping wall is disposed at a second rotation position, the second surface faces the second clamping member and is closer to the second clamping member than the first surface.

6. The lamp clamp according to claim 5, wherein the second stopping wall is protruded from a surface of a turntable, the turntable is rotatably connected to the connecting portion.

7. The lamp clamp according to claim 5, wherein the second surface is an arced surface.

8. The lamp clamp according to claim 1, wherein the stopping portion comprises:

a sliding block, slidably connected to the connecting portion; and a stopping wall, protruding from a first surface of the sliding block and having the stopping surface perpendicular to the first surface.

9. The lamp clamp according to claim 8, wherein the connecting portion has a sliding groove for receiving the sliding block slidably disposed therein to move the blocking wall to one of the plural positions.

10. The lamp clamp according to claim 9, further comprising a plurality of cavities disposed on a bottom of the sliding groove and engaged with at least one protruding portion protruding from a second surface located on an opposite side of the first surface to fix the blocking surface at one of the plural positions.

11. The lamp clamp according to claim 1, wherein the connecting portion is pivotally connected to the second clamping member via a pivot shaft.

12. A lamp apparatus, selectively clamped on an upper edge of a display, wherein the display has a displaying surface and a back surface, and the lamp apparatus comprises:

a light source;

a first clamping member, comprising:

a connecting portion, a first end of the connecting portion connected to the light source; and a stopping portion, movably connected to the connecting portion and having a stopping surface selectively disposed at a first position and a second position on the connecting portion; and a second clamping member, connected to a second end of the connecting portion, wherein when the lamp apparatus is clamped on the upper edge of the display, the stopping surface touches a third position on the displaying surface and the second clamping member touches the back surface; when the stopping surface is disposed on the first position, the light source is separated from the third position on the displaying surface by a first distance; when the stopping surface is disposed on the second position, the light source is separated from the third position on the displaying surface by a second distance, and the second distance is greater than the first distance.

13. The lamp apparatus according to claim 12, wherein the stopping portion comprises:

a first stopping wall, protruding from the first position and having a first surface facing the second clamping member; and a second stopping wall, detachably connected to the connecting portion, extending to the second position and having a second surface facing the second clamping member.

14. The lamp apparatus according to claim 13, wherein the second stopping wall is a casing; when the casing is detachably mounted on the first stopping wall, the second surface serves as the stopping surface; when the casing is dismounted from the first stopping wall, the first surface serves as the stopping surface.

15. The lamp apparatus according to claim 12, wherein the stopping portion comprises:

a first stopping wall, protruding from the first position and having a fixing surface facing the second clamping member; and a second stopping wall, rotatably connected to the connecting portion and having a first surface and a second surface located on an opposite side of the first surface;

when the second stopping wall is dispsoed at a first rotation position, the first surface and the fixing surface are co-planar; when the second stopping wall is located at a second rotation position, the second surface faces the second clamping member and is closer to the second clamping member than the first surface.

16. The lamp apparatus according to claim 15, wherein the second stopping wall protrudes from a surface of a turntable, the turntable is rotatably connected to the connecting portion.

17. The lamp apparatus according to claim 15, wherein the second surface is an arced surface.

18. The lamp apparatus according to claim 12, wherein the stopping portion comprises:

a sliding block, slidably connected to the connecting portion; and a stopping wall, protruding from a first surface of the sliding block and having the stopping surface perpendicular to the first surface.

19. The lamp apparatus according to claim 18, wherein the connecting portion has a sliding groove for receiving the sliding block slidably disposed therein to move the stopping wall to the first position or the second position.

20. The lamp apparatus according to claim 19, further comprising a plurality of cavities disposed on a bottom of the sliding groove and engaged with at least one protruding portion protruding from a second surface located on an opposite side of the first surface to fix the stopping surface at one of the plural positions.

* * * * *